United States Patent [19]

Williamsson

[11] Patent Number: 5,054,963

[45] Date of Patent: Oct. 8, 1991

[54] TETHER SYSTEM FOR AN OFFSHORE BASED WORK PLATFORM

[75] Inventor: Robert Williamsson, Västra Frölunda, Sweden

[73] Assignee: Götaverken Arendal AB, Göteborg, Sweden

[21] Appl. No.: 412,440

[22] Filed: Sep. 26, 1989

[30] Foreign Application Priority Data

Sep. 29, 1988 [SE] Sweden ..... 8803451

[51] Int. Cl.[5] ..... B63B 21/50; B63B 35/44

[52] U.S. Cl. ..... 405/224; 405/203; 405/227; 405/DIG. 8

[58] Field of Search ..... 405/195, 224, 203, 205, 405/227, DIG. 8; 166/338, 366

[56] References Cited

U.S. PATENT DOCUMENTS

| | | | |
|---|---|---|---|
| 3,955,521 | 5/1976 | Mott | 405/224 X |
| 4,354,446 | 10/1982 | Goldsmith et al. | 405/224.1 X |
| 4,818,147 | 4/1989 | Rasmussen | 405/224 |
| 4,844,659 | 7/1989 | Hunter et al. | 405/224 |
| 4,913,591 | 4/1990 | Steele | 405/224 X |
| 4,938,632 | 7/1990 | Eie | 405/224 |

*Primary Examiner*—Dennis L. Taylor
*Assistant Examiner*—John Ricci
*Attorney, Agent, or Firm*—Wegner, Cantor, Mueller & Player

[57] ABSTRACT

A tether system for a semisubmersible work platform which may be based on deep water, comprising a number of pontoon elements mounted in a frame configuration, upright columns and a work deck for exploitation of oil or gas fields below the sea bottom. The system comprises a sea bed anchor template, which is provided with receptacle means for tendons, running up to connectors at the work platform. The receptacle means in the sea bed anchor template are located along a circular track on which a carrier can move. The carrier has sheave means for one or more handling line for a tendon which is provided with a running collar. The connectors for the upper ends of said tendons are located at the outside of the columns.

14 Claims, 12 Drawing Sheets

TETHER SYSTEM FOR AN OFFSHORE BASED WORK PLATFORM

FIELD OF THE INVENTION

The present invention relates to a tether system for a semisubmersible work platform which may be based on deep water, comprising a number of pontoon elements mounted in a frame configuration, upright columns and a work deck for exploitation of oil or gas fields below the sea bottom, said system comprising a sea bed anchor template, which is provided with receptacle means for tendons, running up to connectors at the work platform.

BACKGROUND OF THE INVENTION

The installation of a work platform according to the above is a difficult operation requiring favorable weather conditions and very large efforts in vessels, equipment and personnel.

In a prior art example of a tension leg moored platform, the platform is positioned in an exact position above its sea bed anchor template. Then a number of tendon strings are lowered down from the bottom of each respective column, with the same technique as a drill string, i.e. short sections are added while the string is lowered down from a derrick-like device in each column. Each of these strings should "target" its special anchoring point in the template. This complicated method normally takes several days and requires very good weather, small waves and considerable assistance in the form of stable anchored barges, serving as dampers for pendulum motions.

As an alternative to this prior art tether system, it has been proposed in U.S. Pat. No. 4,418,147 to prefabricate the tendons in full length and pre-install them at the sea bed anchor template, whereafter the platform can be moved out to the location and be connected to the upper ends of the tendons. Also this tether system is dependant upon good weather and small waves. Besides, a comprehensive system of wire lines must be used for guiding both ends of the tendons into their respective locations. Special problems may arise when it is time to exchange one of the tendons while the platform is on its location.

SUMMARY OF THE INVENTION

One object of the invention is to provide a tether system which simplifies the handling of both ends of each tendon, and thus reduces the above described drawbacks.

For this object, the tether system according to the invention is characterized in that the receptacle means in the sea bed anchor template are located along a circular track on which a carrier can be displaced, said carrier having sheave means for one or more handling lines for a tendon which is provided with a running collar, and wherein the connectors for the upper ends of said tendons are located at the outside of the columns. The guidance of the upper and lower ends of the tendons will be achieved by simple means because of this design of the tether system.

According to one preferable embodiment of the invention, the upper end of each tendon is flexibly connected to a ballastable float element. Since the tendons reach up along the platform columns, the float element can form a vertical cylindrical buoy which is accessible at the sea surface during the installation, said shape being preferable in order to minimise influence from wave induced motions.

The connectors for the upper ends of the tendons preferably comprise lower connector means for absorbtion of angle variations in the longitudinal direction of the tendons, said lower connector means being located at the lower ends of the columns, and upper connector means which are located above the operational water line of the platform for absorbtion of vertical load. In this way, bending is avoided between the lower edge of each column and the respective tendon. Also, the loads are distributed along the columns and maximum availability is obtained.

Preferably, each upper and lower connector means is provided with a slit formed opening enabling radial entrance of the float element into the upper connector and axial entrance of said float element into said lower connector.

The upper connector means preferably comprises hydraulic press means which can be applied against the tendons during installation of the work platform, enabling a temporary arrest of the platform in relation to the tendons, during any of the lower turning points in the heave amplitude of said platform. These hydraulic means may preferably be used above the water line.

The hydraulic press means are preferably combined with screw means, which are arranged for permanent arresting of the platform at a suitable position along the tendons, so that the hydraulic press means normally may be unloaded.

According to another preferable embodiment of the invention, a handling line which runs through said sheave means in the carrier, extends from a first pulley means at the surface of the sea, down to said sheave means and back up to the running collar which is able to run along substantially the whole length of the tendon and can be longitudinally divided, and from which a second handling line extends up to a second pulley means at the sea surface. This embodiment of the invention makes it possible to handle the lower end of a tendon with only one or one pair of handling lines.

The receptacle means in the sea bed anchor template preferably has tangential openings into an imaginary circle of tendon receptacle means for the lower ends of the tendons, enabling tangential entrance of said lower end of the respective tendon, by means of said running collar gripping around said tendon end and in cooperation with said carrier which is connected to the collar via the handling line.

Preferably, the carrier is adapted to run upon rail means, forming the ring formed track extending along the tendon receptacle means.

According to still another embodiment of the invention, a remotely operated submarine vehicle is adapted to move the carrier along the rail means. The use of a remotely operated submarine vehicle is an economical and efficient way to provide propulsion for moving the carrier along the rail means.

BRIEF DESCRIPTION OF THE DRAWINGS

The above described and other aspects of the invention will now be described in more detail in the following with reference to the accompanying drawings, in which.

DESCRIPTION OF A PREFERRED EMBODIMENT

Figure 1:
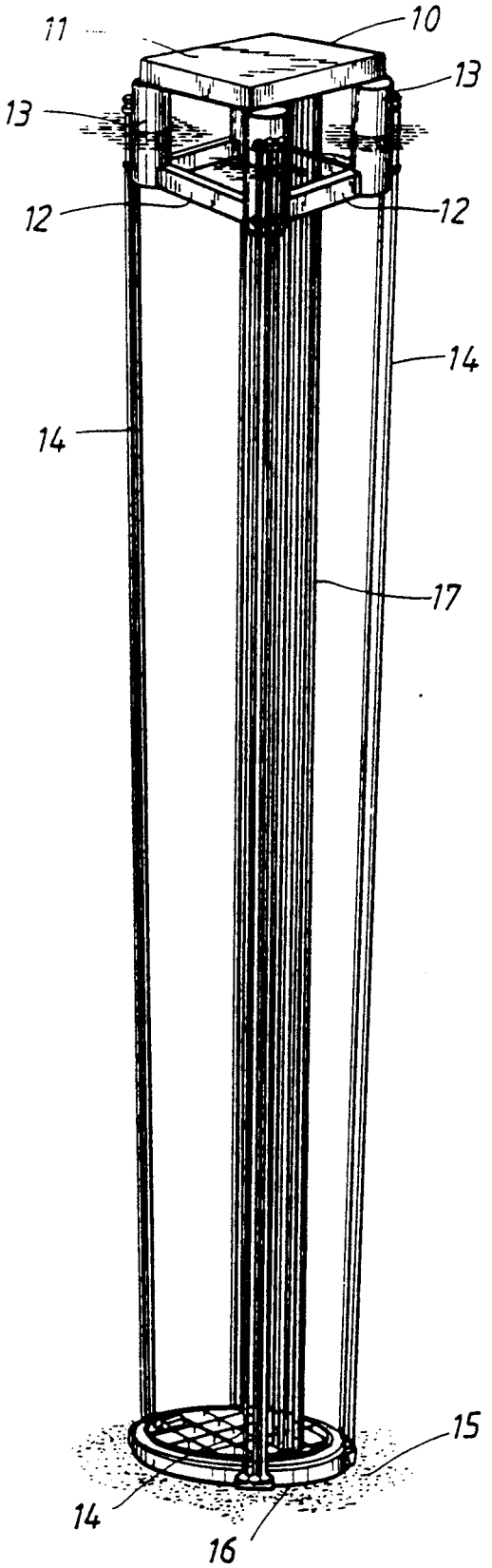
FIG. 1 is a diagrammatical perspective view showing a complete tether system according to the invention.

The work platform 10 shown in the figure can for example be used for offshore-based production of oil and gas, and comprises a work deck 11, four pontoon elements 12 placed in a frame configuration and four upright columns 13, on which the work deck rests. The platform 10 is connected via tendons 14 to a seabed 15 anchor template 16 having a substantially circular shape in the embodiment (see FIG. 1).

A tether system with tendons preferably can be used on large depths, e.g. up to a depth of about 3000 meters, and amounts to that the buoyancy of the platform is utilized to pre-tension the tendons. This results in that operation on the platform may continue relatively undisturbed, independent of weather and wave conditions. Besides, stiff risers 17 may be used with production valves placed on the deck, which is a large advantage from the views of cost, maintenance availability and security.

In the tether system according to this invention, the tendons are arranged along the circumference of the circular sea bed anchor template 16 extending up to the outside of the platform columns 13. This arrangement is beneficial both during the installation of the platform, during its operation and during exchange of a single tendon.

In the following, a method for installation of the platform will be described more closely.

The tendons 14 can be prefabricated and towed in full length to the installation site. However, if the tendons are very long, or if the towing distance is long, it may be preferable to transport the tendons on a barge, for example, in 200 meter long sections, which are launched substantially horizontally from the barge while they are successively assembled to their full length, either by screw joints, welding or any other comparable method.

Figure 2:
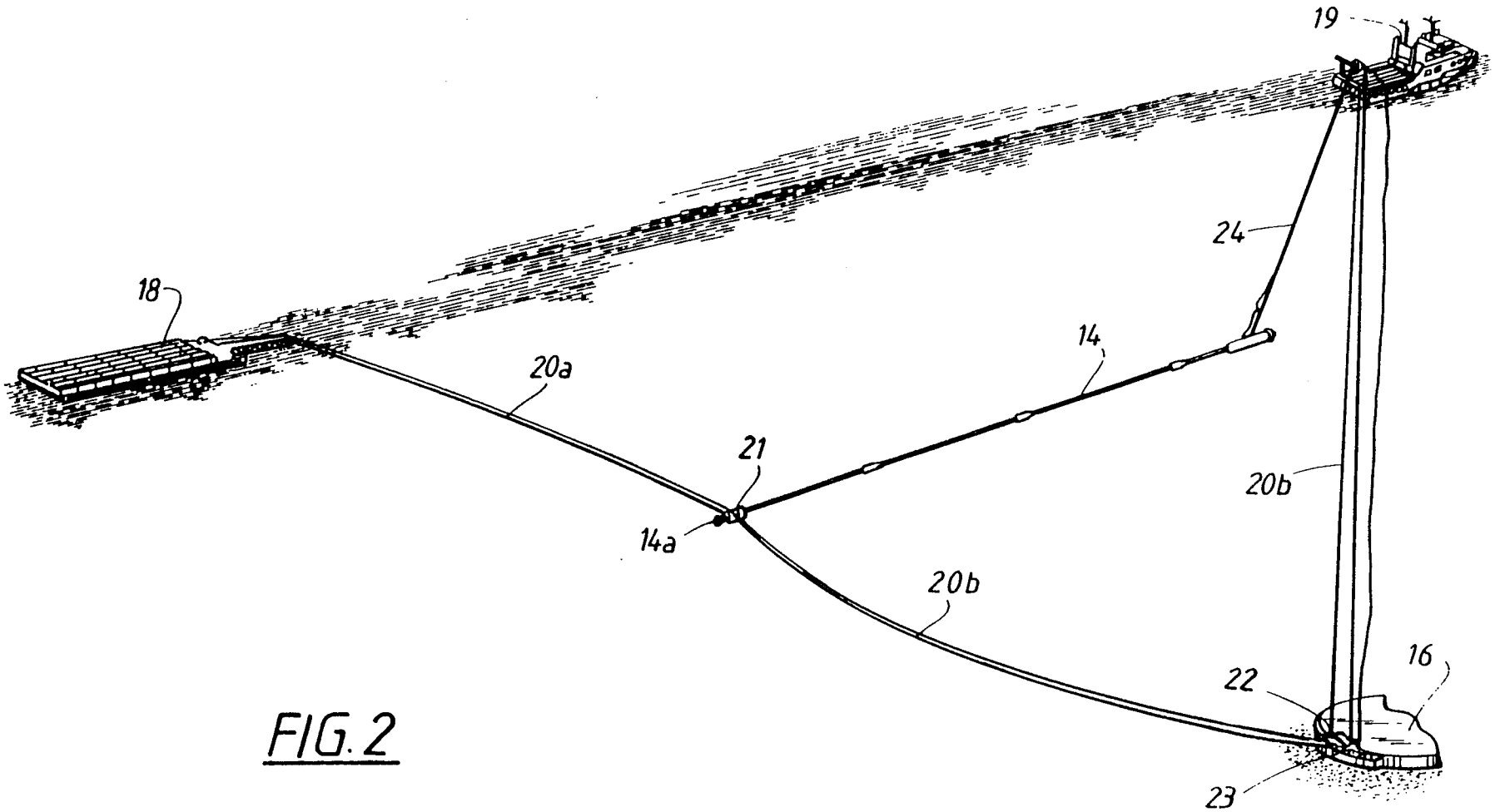
FIG. 2–6 shows one of the tendons being installed.
Figure 4:
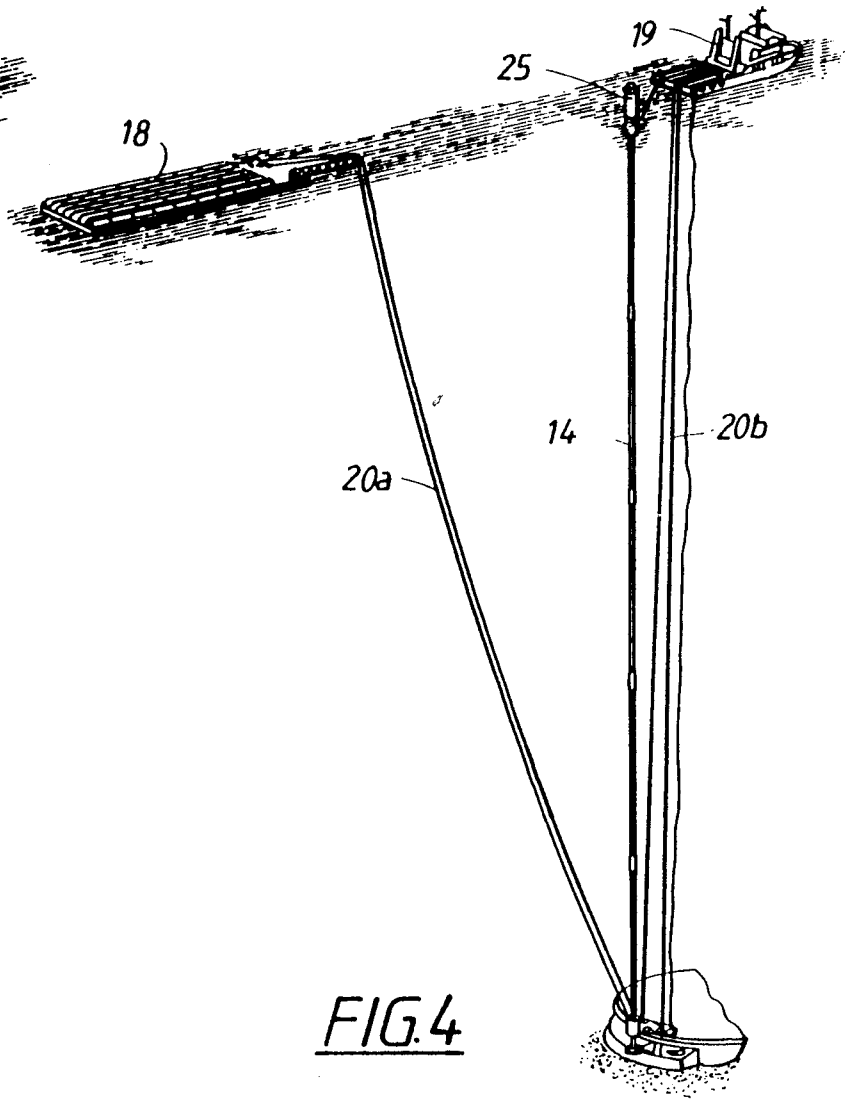

FIG. 2 shows how such a composite tendon 14 is handled, at one end by that barge 18, on which it has been assembled, and at the other end by a supply vessel 19. For this task a pair of handling lines **20*a* are used, which run from winch means on the barge 18 and are connected to a running collar 21 which in FIG. 2 is positioned at the bottom end 14*a* of the tendon, and a second pair of lines 20*b* run further downward from said collar 21 to wire sheaves 22 on a carrier 23 which can be moved along the sea bed anchor template, and will be described later in more detail. The handling lines 20*b* pass through these sheaves 22 and run further upwards to winch means on the supply vessel 19, said winch means also comprise a hoisting line 24, running to the top end 14*b* of the tendon. With the help of the these lines, the tendon 14** can be lowered down to about half the water depth.

Figure 3:
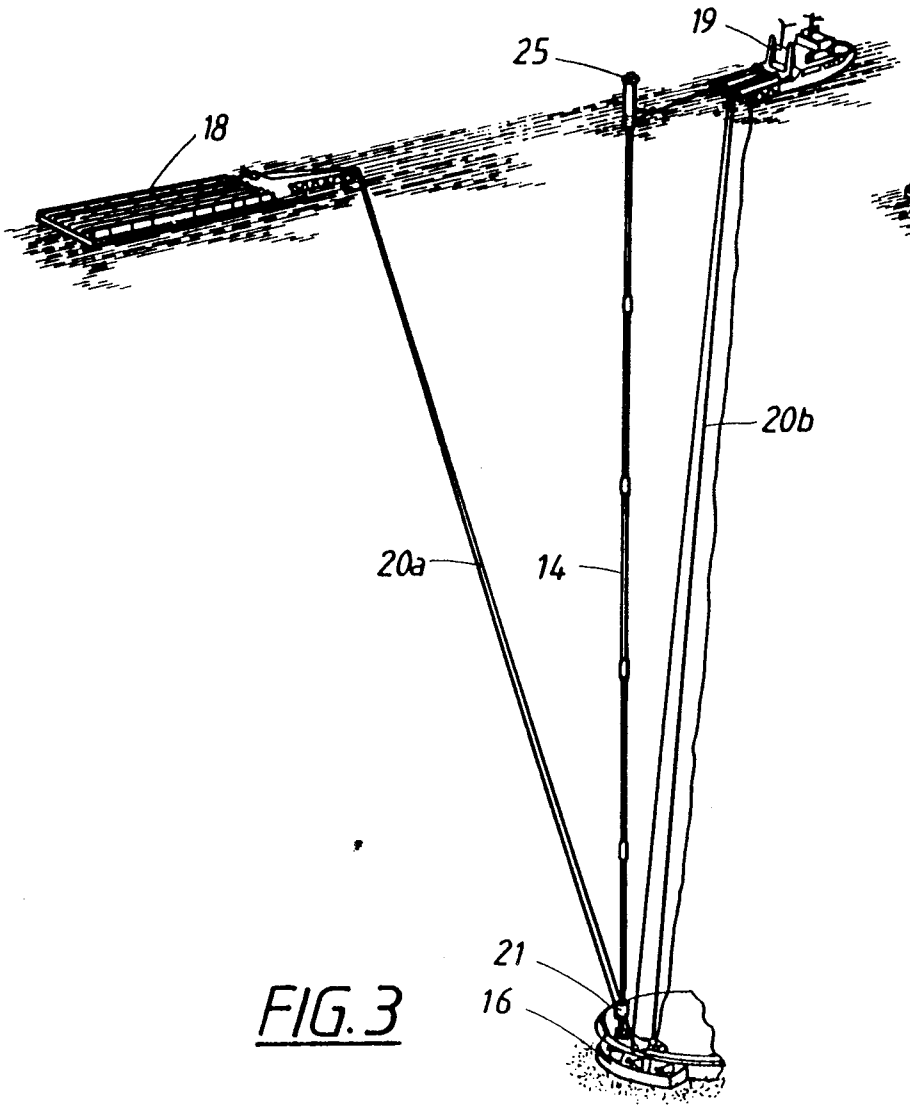

Then the top end of the tendon will be hoisted up to the surface, by means of the hoisting line 24 which is connected to the winch means on the supply ship 19. The bottom end of the tendon is simultaneously lowered down to the bottom by means of the hoisting lines **20*a*, which are connected to the winch means on the barge 18. Simultaneously, the winch means on the supply vessel take up the slack in the line ends 20*b*. Finally, the tendons will assume the vertical position shown in FIG. 3, with the lower end 14*a* being close above the sea bed anchor template 16, and top end 14*b* floating adjacent to the water surface. In order to stabilize said top end, it comprises a tubular float element 25, sticking up above the water surface. Thereafter, a hose from the supply vessel will be connected to the float element 25 and all water will be pumped out of said element while the float element is filled with air, so that the top end 14*b*** of the tendon gains enough buoyancy to stay at the surface.

Now the bottom end **14*a* of the tendon can be pulled down and in towards a seat 23*a* in the carrier 23 (see FIGS. 7–10) by means of the pulling force in the handling lines 20 on the running collar 21, which abuts a flange 21*a* on the tendon 14**.

Figure 8:
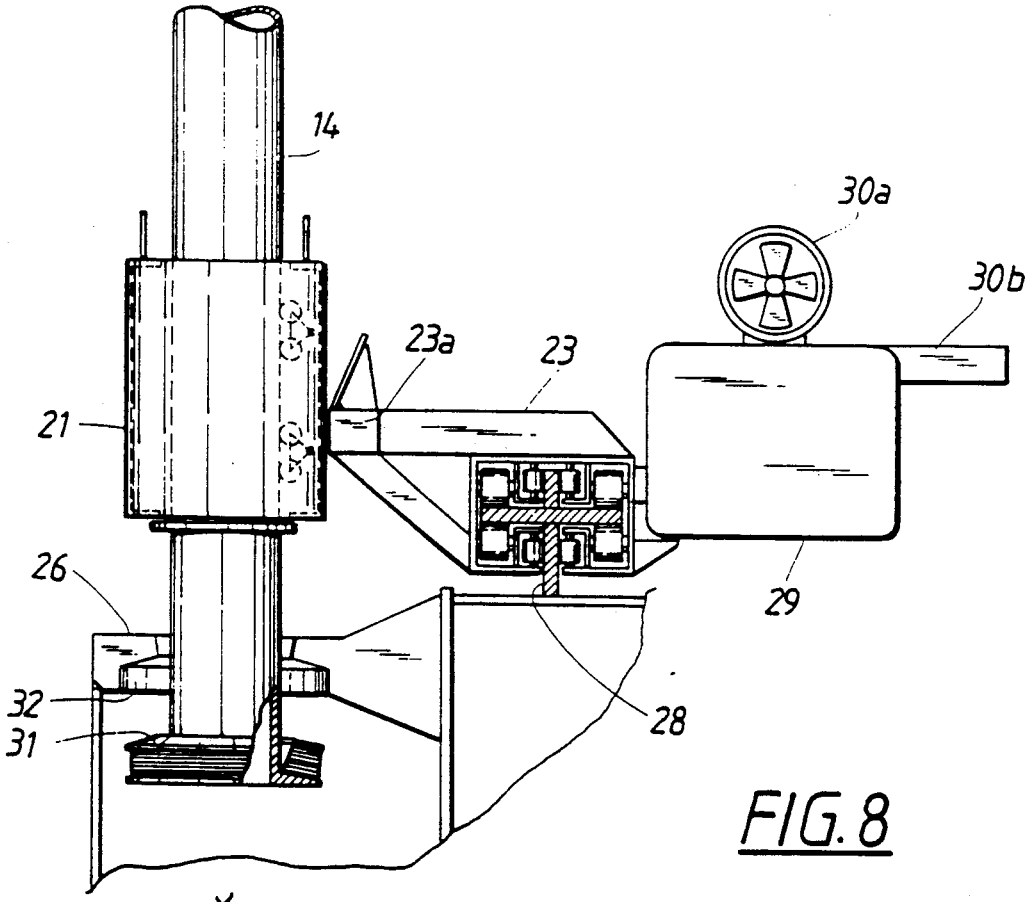
FIG. 8 is a section along the line VIII—VIII in FIG. 10.
Figure 9:
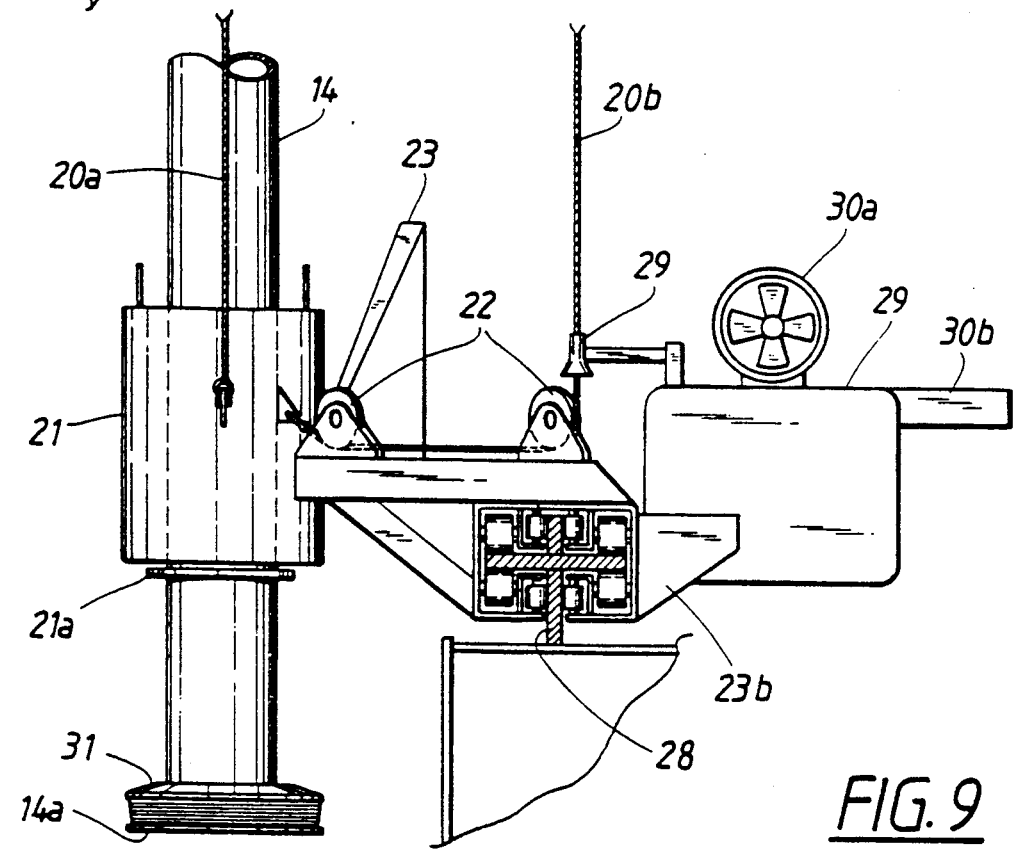
FIG. 9 is a section along the line IX—IX in FIG. 10.

The sea bed anchor template 16 has four groups, in this embodiment each group comprising three receptacle means 26 for the bottom end **14*a* of the tendon. These receptacle means comprise tangentially arranged openings 27. The carrier 23 is mounted via bearing rollers upon a cross section rail 28, which enables an exact guidance of the carrier along the rail. The carrier 23 can be driven in any direction along the rail by means of a remotely operated submarine vehicle 29 which has horizontal thrusters 30*a*. This vehicle 29 is able to move up and down along the handling lines 20 via guide tubes 29*a*, to and from its work position between the two shanks 23*b* of a frame. According to the art, the submarine vehicle is equipped with TV-cameras for surveillance of the operation, and its horizontal thruster 30*a* can deliver a constant thrust force of about three tonnes, while moving the carrier 23 along the rail 28. A corresponding vertical thruster 30*b* is used occasionally to counteract a clockwise moment of rotation around the rail 28**, as seen in FIG. 8 and 9.

Figure 10:
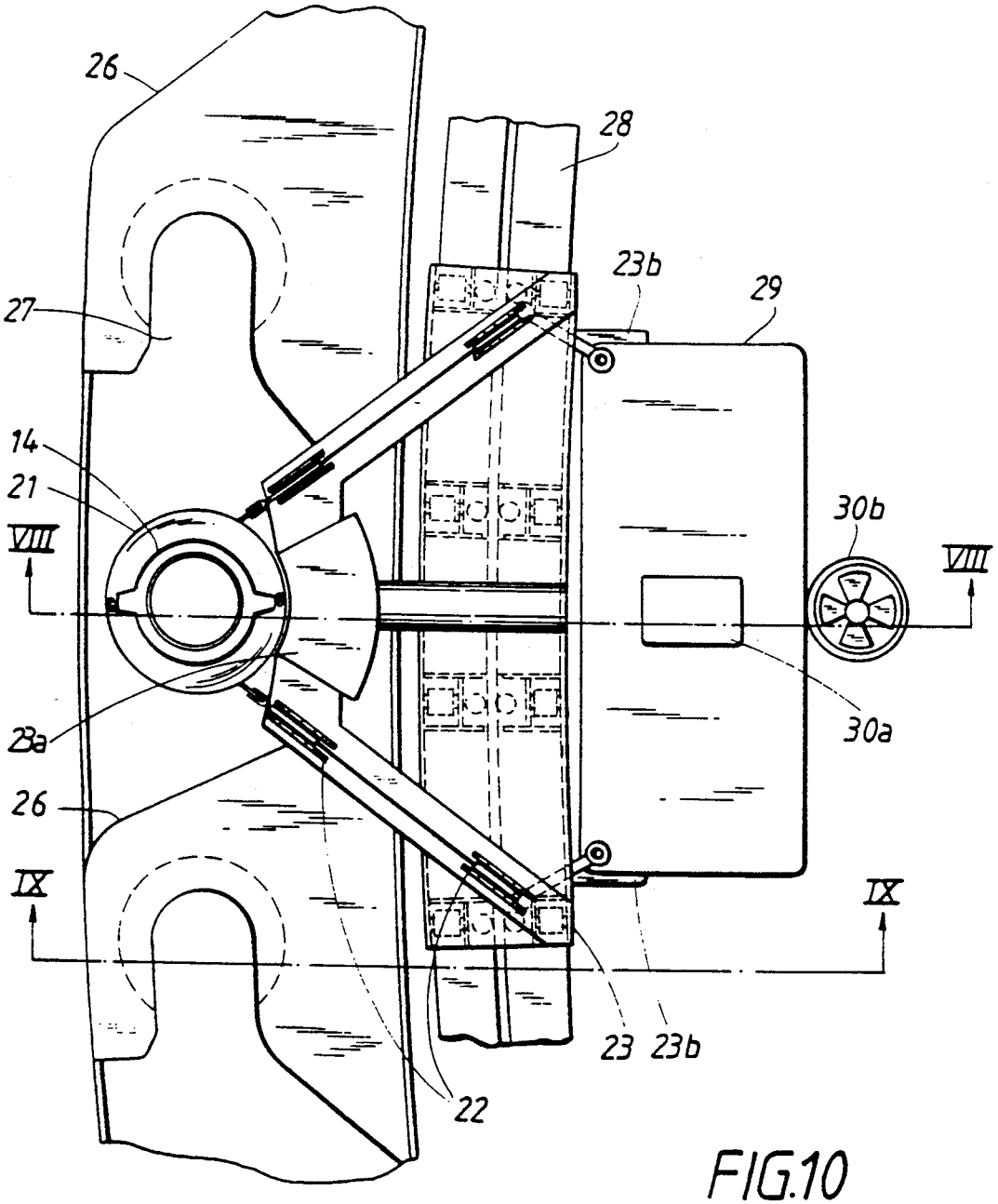
FIG. 10 is an elevation view of a carrier for connection of the lower ends of the tendons in the sea bed anchor template.

When starting the installation procedure, when the bottom end **14*a* of the tendon is inserted into the seat 23*a*, the carrier 23 assumes the position shown in FIG. 10. Then the horizontal thruster 30*a* is activated, so that its force of reaction moves the carrier 23 upward in the figure, and vertical thruster 30*b* is also activated to counteract the lift in the tendon 14 which is generated by the float element 25. This results in that the bottom end 14*a* of the tendon is moved into the opening 27 in the connector 26, so that an elastically mounted flange collar 31 at said end is located directly below a seat 32 in the connector 26. Then the handling lines 20*b* which are connected to the supply vessel 19 are slacked, enabling the tendon to float axially upward, until the flexible end flange 31 is seated in the seat 32. Then the running collar 21 can be pulled upward along the tendon 14** by means of the handling lines 20*a* which lead up to the barge 18, simultaneously as the handling lines 20*b* are slacked further.

Figure 6:
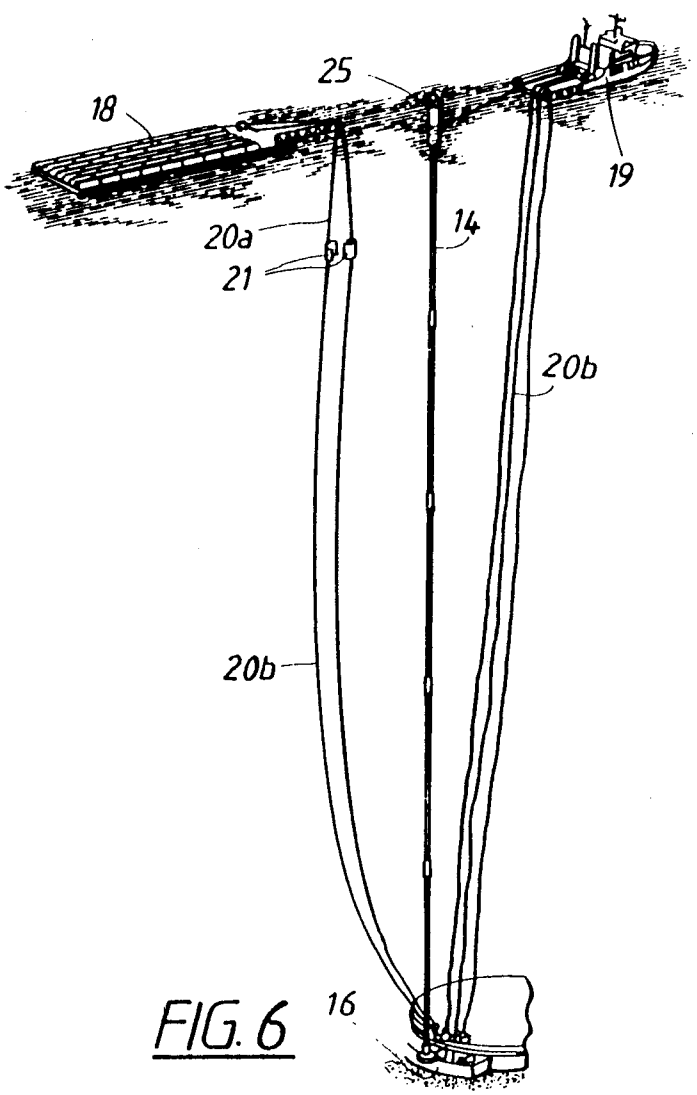
Figure 5:
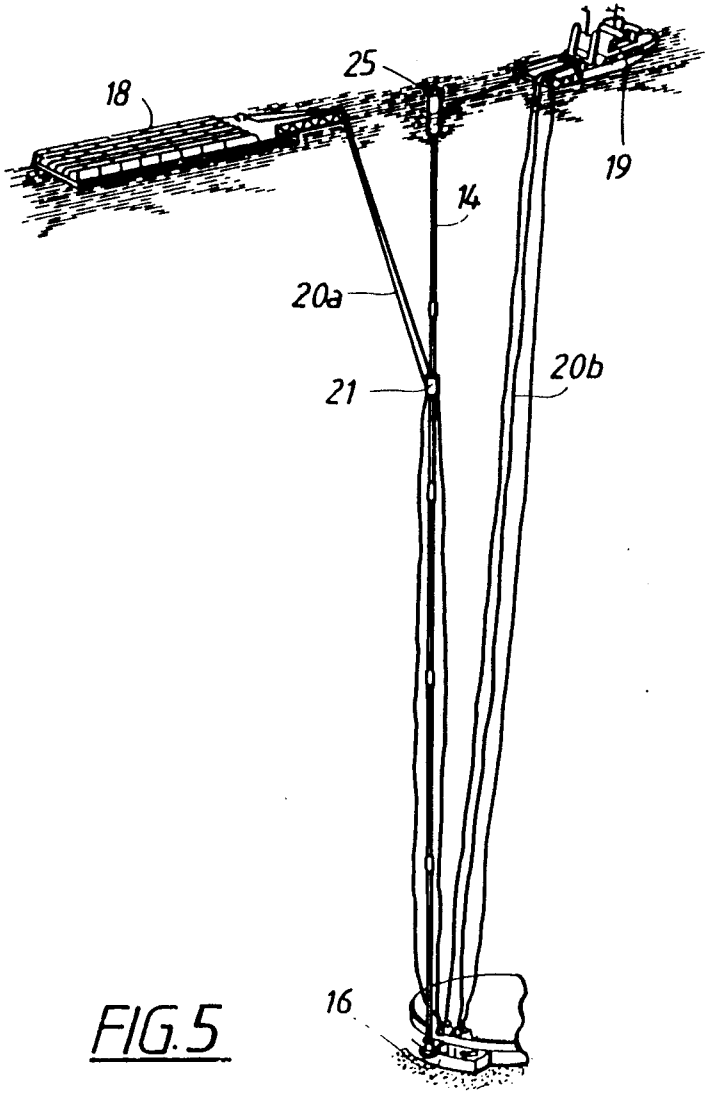
Figure 7:
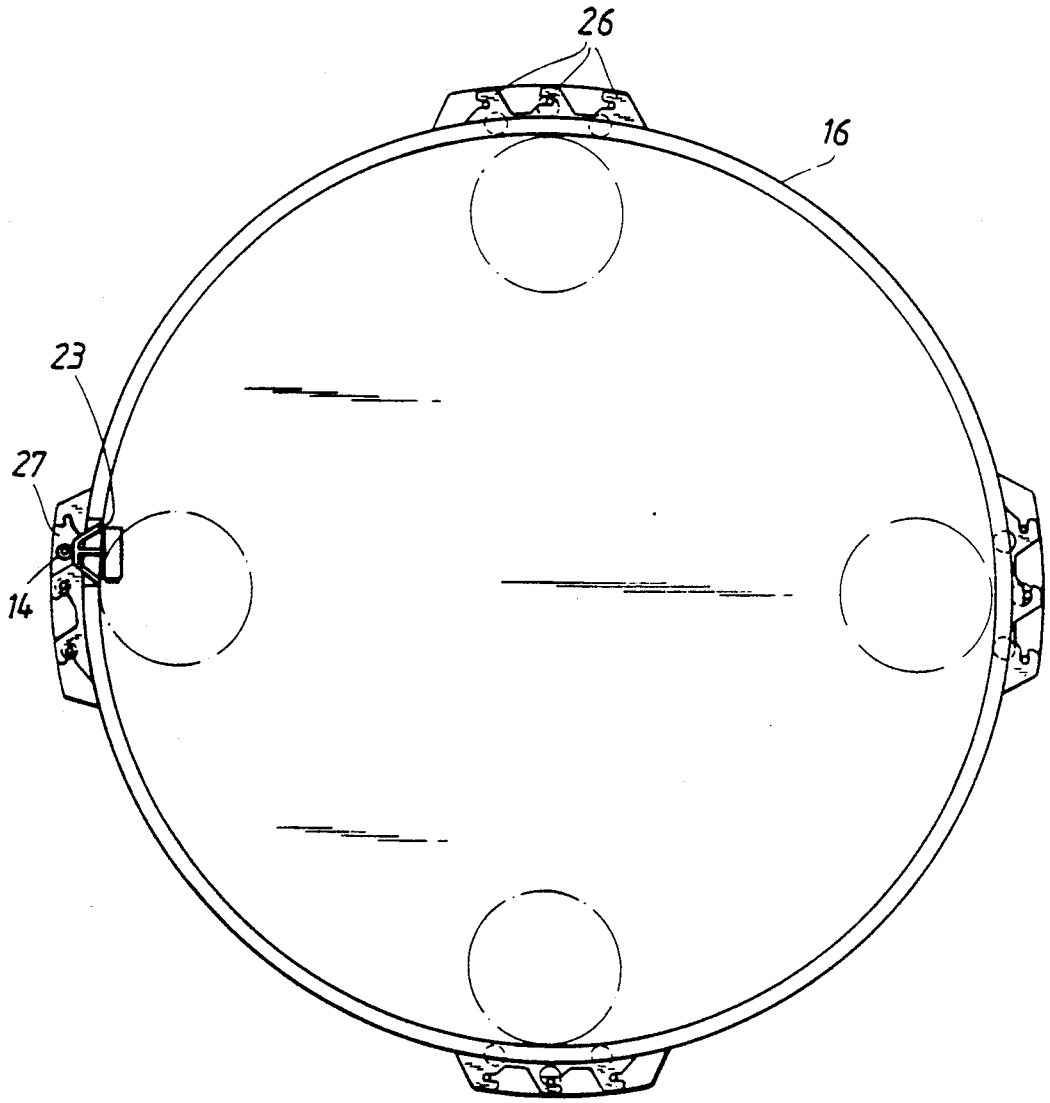
FIG. 7 is a diagrammatical view showing the arrangement of receptacles for the tendons in the sea bed anchor template.
Figure 11:
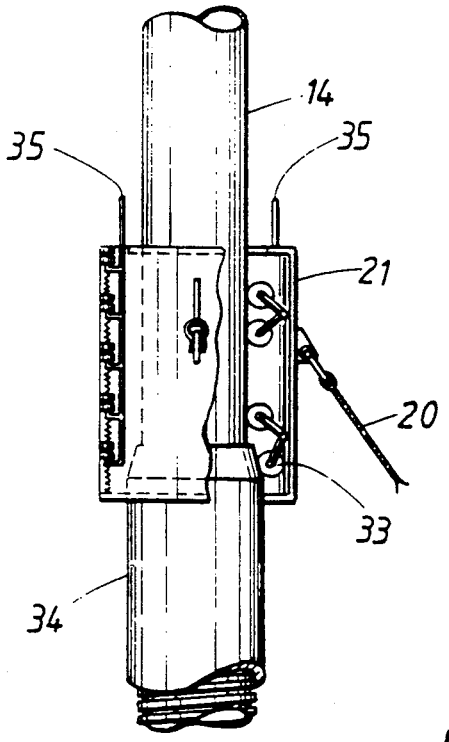
FIG. 11 is a broken view of a tendon with a running collar.
Figure 12:
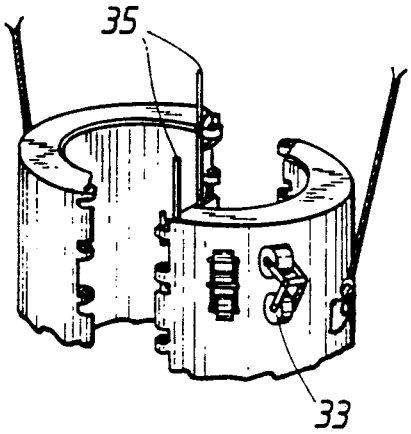
FIG. 12 shows the running collar in a parted condition.

The running collar is shown in more detail in FIGS. 11 and 12, from which it will be clear that the collar is provided with inner, resilient support rollers 33, facilitating the collar to pass unobstructed by the screw joints 34 on a screw spliced tendon. The collar 21 also comprises release pins 35, which are arranged to be released when the collar reaches the under side of the float element. The running collar 21 will then be divided axially in two halves, as is shown in FIG. 6. These two halves can be pulled away to the side from the newly installed tendon, and will be applied upon the next following tendon, which now can be launched from the barge 18.

The above described procedure is repeated for installation of all twelve tendons, while using the same running collar 21, the same handling lines 20 and the same carrier 23.

FIGS. 13–17 illustrate the coupling together of the platform 10 and the top end 14*b* of the tendons. During this operation, the platform 10 is ballasted down about six meters more than normal, and it is pulled into the center of the four groups of float elements 25 floating at the water surface. The upper ends of the columns 13 are each provided with three winches 36 having horizontally telescopic arms for handling the top end of each tendon. The lifting line 36*a* belonging to each of the telescopic winches is fastened to the respective upper end of 37 of the float element 25. Then all lifting lines 36*a* are tightened with a load of about 30 tonnes. The platform now assumes the position shown in FIG. 13, wherein, however, only one tendon is shown. The telescopic winch arms 36 are now retracted towards the respective column 13.

Upper and lower connectors 38 and 39 respectively for each of the float elements 25, are located at the outside of each corner column. These are shown in more detail in FIGS. 15 and 16, from which it is also clear that the tendon 14 is screwed into a flange 40, which via resilient rubber elements 41 form a resiliently tiltable connection with the float element 25. The lower connector 39 comprises a holder with an opening 42, which is wide enough to enable a radial insertion of the tendon 14, and a sleeve 43 with a corresponding opening. The upper connector 38 comprises a holder with an opening 44, which is wide enough to enable a radial insertion of the float element 25.

Figure 13:
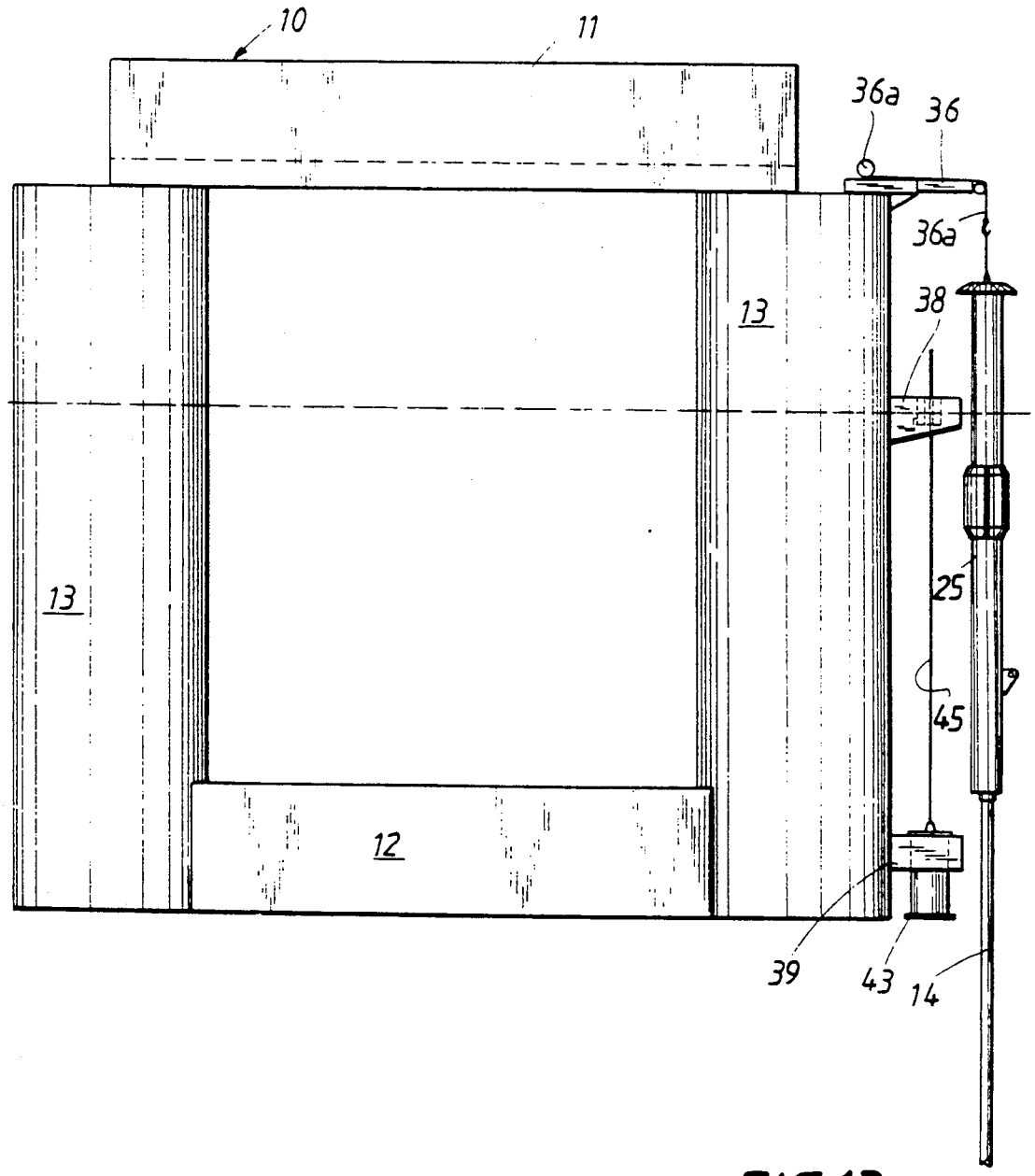
FIG. 13 and 14 shows the compete platform during connection of a tendon.
Figure 14:
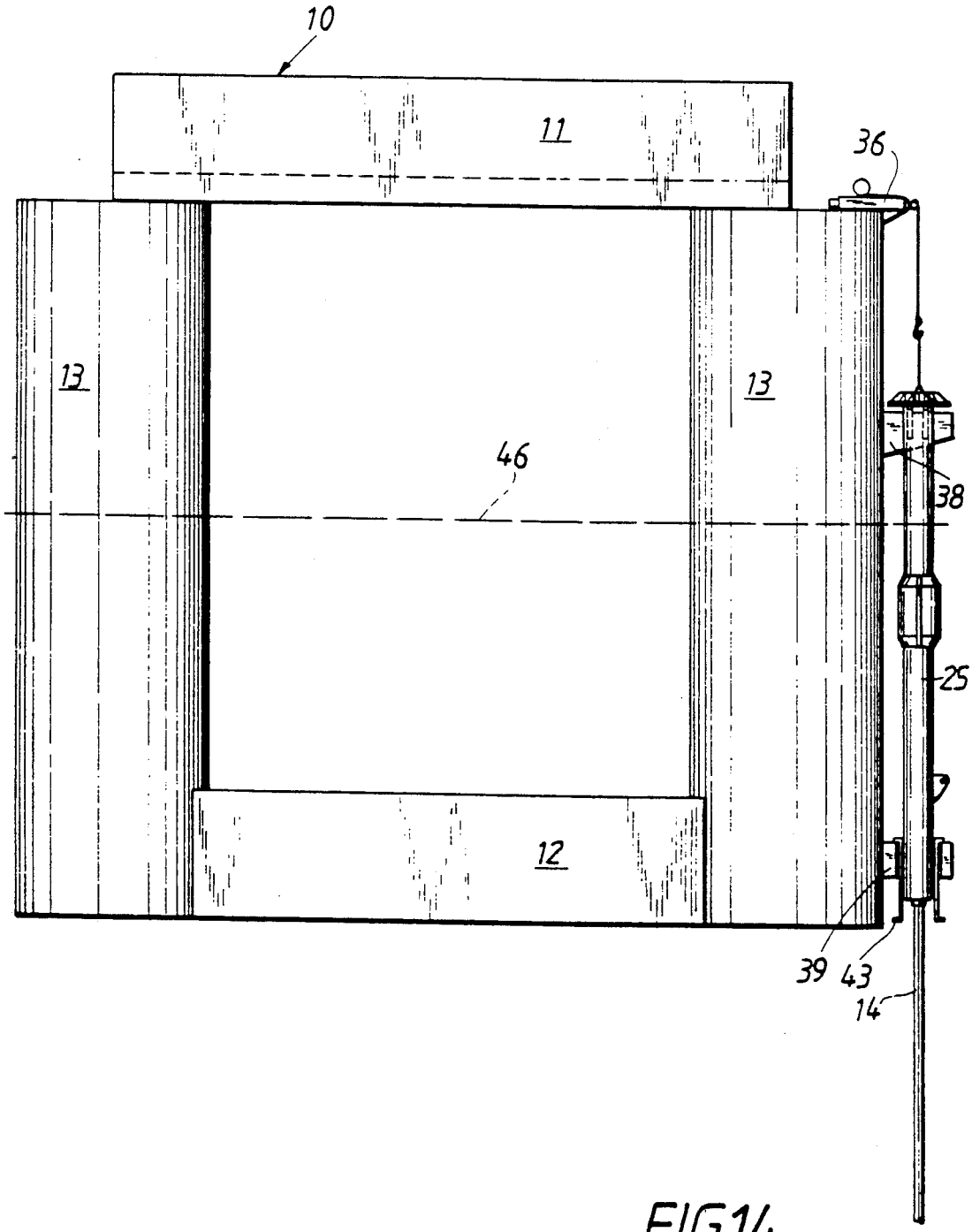
Figure 15:
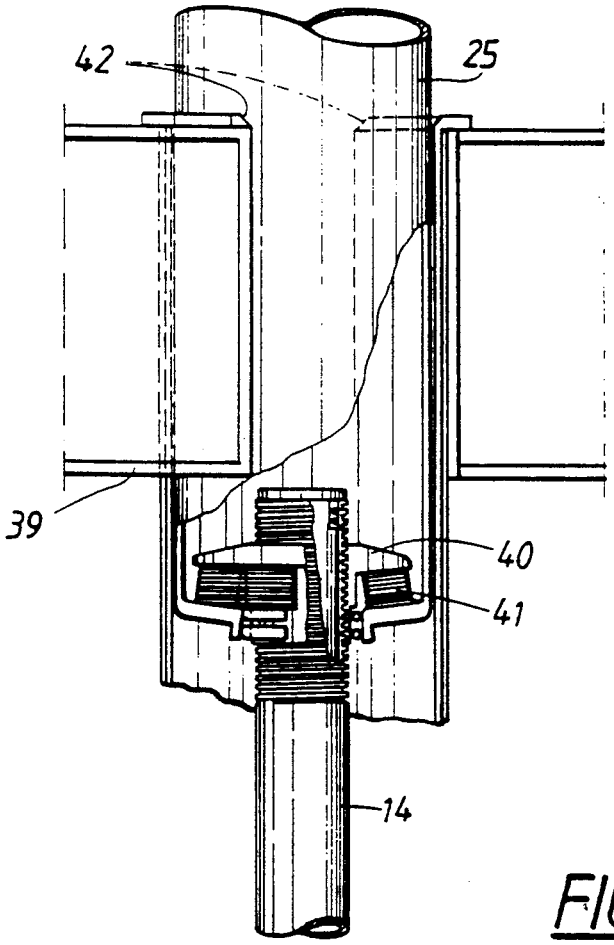
FIG. 15 shows upper connection of the tendon in a float element, which is mounted at the platform column.
Figure 16:
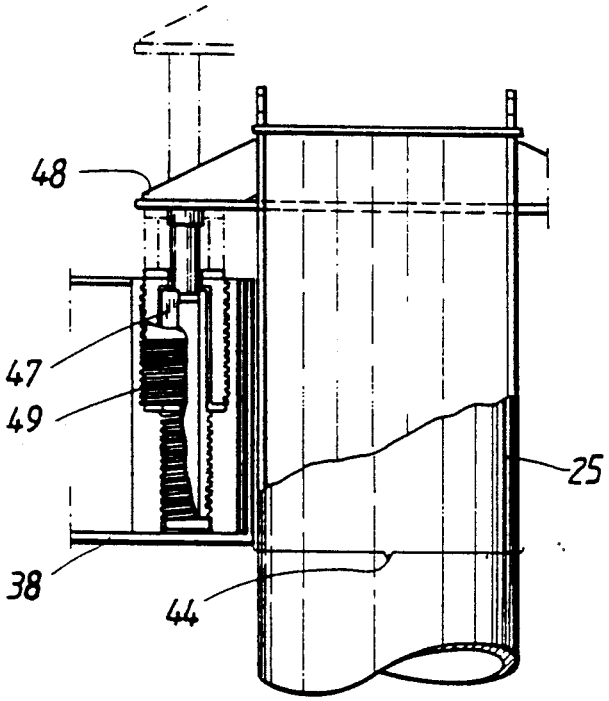
FIG. 16 shows the connection of the upper end of the float element at the platform column.
Figure 17:
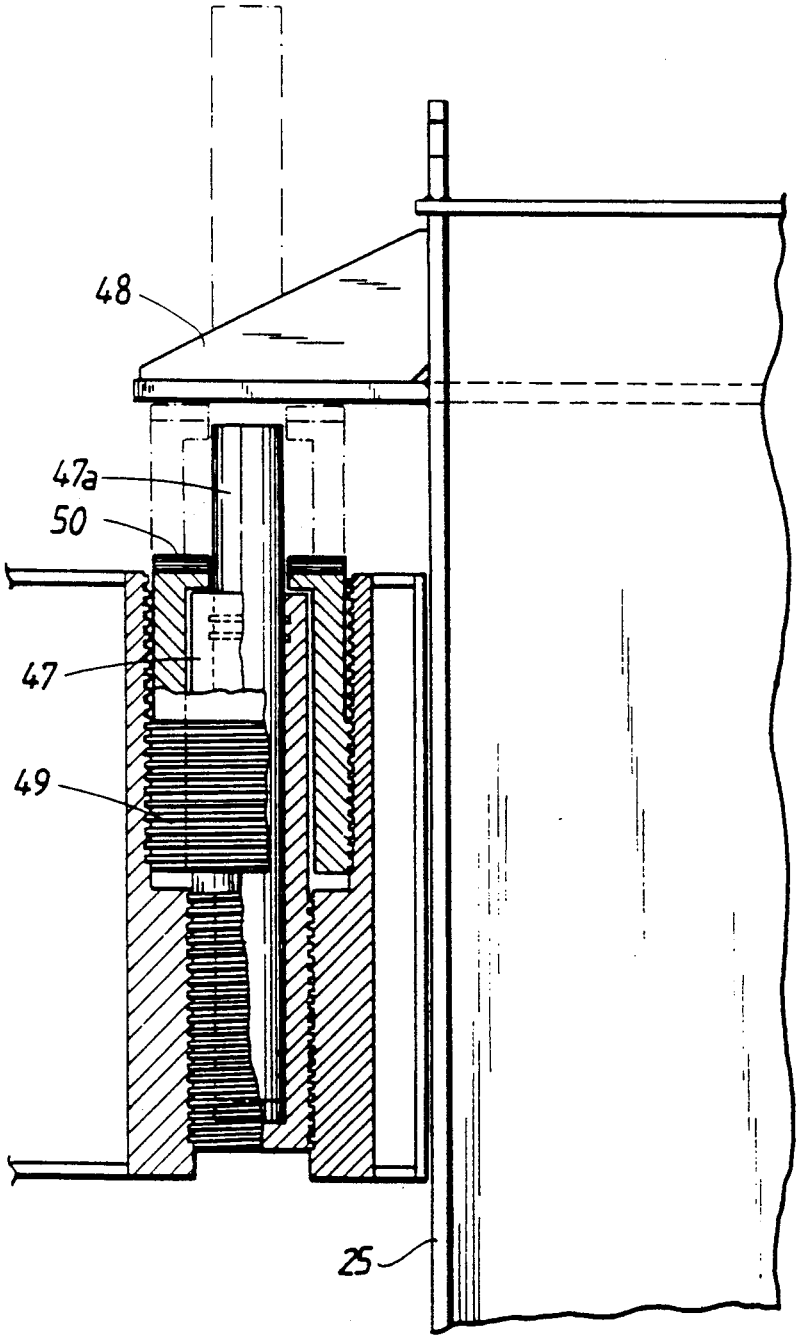
FIG. 17 shows means for adjustment of the tension in the tendons.

The winch arms 36 can be retracted from the position shown in FIG. 13 pulling the float element with the tendon into the upper and lower holders. Simultaneously, the sleeve 43 is lifted somewhat by means of a lifting line 45. These sleeves 43 aid in guiding the float elements 25 axially into the lower connectors 39, which is done by pumping ballast successive out of the platform 10, so that it rises vertically until its about 1.5 meter below the normal operational water line 46 shown in FIG. 14. During this phase the platform is still following the motions of the waves, and since the telescopic arm winches, according to the art, are provided with passive heave compensation, this results in that the lifting lines 36*a* can be stressed with a constant load while maintaining this relative motion between the platform and the tendons. Now it is possible to change over from this substantially free heaving condition, to the tension leg moored condition.

For this purpose hydraulic jack cylinders 47 (see FIGS. 16 and 17) are used, which are arranged to act against a head 48 on the float element 25. Four of these jack cylinders 47 are arranged in each of the upper holder 38 and are at normal sea level positioned at a level of about seven meters above the operational water line 46. The stroke of the jack cylinder pistons is about 1.5 meter and they are loaded with a suitable pressure and a gradually reduced internal valve flow, which makes it possible for the pistons to follow the static and dynamic heave motions of the platform while gradually reducing the platform ballast, until the platform has moved up to near its operational level. While the pistons 47*a* are pressed up and down within their cylinders 47, the stroke is gradually reduced. Simultaneously, the amplitude motions of the platform are supervised and one moment is chosen when one of corners of the platform is at the bottom of a wave trough, for the locking of the pistons 47*a* in said corner at the turning point of the heave motion, when the acceleration is minimal. This locking procedure is repeated for the other three corners, and the platform has now ceased to follow the wave motions. The pistons can now be adjusted until the tension is equal in all tendons by supervising the hydraulic oil pressure acting against each float element head. In this position a screw means 49 arranged coaxially on each of the cylinders 47 will be screwed upward by means of an airmotor until they abut the head 48, wherein the pistons 47*a* can be retracted into their respective cylinder 47. In this position the platform is fixed to the tendons and the installation is completed. The screw means 49 comprise load sensing cells 50, which are used for continuous surveillance of the tension in the tendons. If any later adjustment of a tendon should be needed, its hydraulic pistons can again be applied against the head 48, whereafter the axial level of the screw means can be adjusted without friction.

The above described installation method can be effected without any diver assistance at all, since the tendons reach up to the sea surface and no connection work has to be done at the bottom of the platform. Also, the exchange of a tendon is simplified. The operative hydraulic and screw means are located above the sea surface and are easy to maintain or, if necessary, to replaced.

The invention is not limited to the above described embodiment, but several modifications are possible within the scope of the accompanying claims. For example, the means for locking the platform in relation to the tendons may be differently designed. The sea bed anchor template can have a rectangular configuration, instead of circular as shown. The number of tendons 14 can vary within the scope of the invention.

What we claim:

1. A tether system for a semi-submersible work platform which comprises pontoon elements mounted in a frame configuration, upright columns extending from said pontoon elements, and a work deck supported by said upright columns, said system comprising:

a circular sea bed anchor template;

tendons for connecting said work platform to said anchor template, wherein each of said tendons comprises a collar movable along a longitudinal direction of the tendon;

tendon connection means for connecting upper ends of said tendons to said work platform, wherein said tendon connection means comprises lower connector means for absorbing forces exerted on the tendons along a direction deviating from a longitudinal direction of the tendons, said lower connector means located at lower ends of said upright columns, and upper connector means for absorbing vertical forces on the tendons, said upper connector means located along said upright columns above an operational water line of the work platform;

lower tendon receptacle means for receiving lower ends of said tendons, said lower tendon receptacle means attached to the anchor template;

means for inserting the lower ends of the tendons into said lower tendon receptacle means; and means for guiding a tendon handling line connectable to said collar, said means for guiding connected to said means for inserting the lower ends of the tendons.

2. The system according to claim 1, wherein said means for guiding comprises at least one sheave connected to said means for inserting the lower ends of the tendons.

3. The system according to claim 2, further comprising a first handling line extending from a first pulley at the surface of the water, through said sheave and to a collar which is movable along a longitudinal direction of one of said tendons, and a second handling line extending from said collar to a second pulley at the surface of the water.

4. The system according to claim 1, wherein said tendon connection means further comprises ballastable float elements flexible connected to the upper ends of the tendons at the lower connector means.

5. The system according to claim 4, wherein said lower connector means further comprises an opening for axial insertion of one of said float elements and said upper connector means further comprises an opening for radial insertion of one of said float elements.

6. The system according to claim 1, wherein said upper connector means comprises means for temporarily arresting the work platform in relation to the tendons during connection of the work platform to the tendons.

7. The system according to claim 6, wherein said means for temporarily arresting comprises a hydraulic cylinder.

8. The system according to claim 6, wherein said upper connector means further comprises means for permanently arresting the work platform in relation to the tendons at a desired position.

9. A tether system for a semi-submersible work platform which comprises pontoon elements mounted in a frame configuration, upright columns extending from said pontoon elements, and a work deck supported by said upright columns, said system comprising:

a circular sea bed anchor template, said sea bed template comprising a circular track;

tendons for connecting said work platform to said anchor template;

tendon connection means for connecting upper ends of said tendons to said work platform, wherein said tendon connection means comprises lower connector means for absorbing forces exerted on the tendons along a direction deviating from a longitudinal direction of the tendons, said lower connector means located at lower ends of said upright columns, and upper connector means for absorbing vertical forces on the tendons, said upper connector means located along said upright columns above an operational water line of the work platform;

lower tendon receptacle means for receiving lower ends of said tendons, wherein said lower tendon receptacle means is attached to the anchor template and comprises tangential openings formed n a circular pattern along said circular track, each of said openings for tangentially receiving the lower end of one of said tendons;

means for inserting the lower ends of the tendons into said lower tendon receptacle means, wherein said means for inserting is movable along said circular track; and a remote controlled vehicle for driving said means for inserting along said circular track.

10. A tether system for a semi-submersible work platform which comprises pontoon elements mounted in a frame configuration, upright columns extending from said pontoon elements, and a work deck supported by said upright columns, said tether system comprising:

a sea bed anchor template having a circular track;

tendons for connecting said work platform to said anchor template, wherein each of said tendons comprises a collar movable along a longitudinal direction of the tendon;

tendon connection means for connecting upper ends of said tendons to the upright columns of said work platform;

lower tendon receptacle means for receiving lower ends of said tendons, wherein said lower tendon receptacle means is attached to the anchor template and comprises tangential openings formed in a circular pattern along said circular track, each of said openings for tangentially receiving the lower end of one of said tendons;

means for inserting the lower ends of the tendons into said lower tendon receptacle means, wherein said means for inserting is movable along said circular track; and means for guiding a tendon handling line connectable to said collar, said means for guiding connected to said means for inserting the lower ends of the tendons.

11. The system according to claim 10, wherein said means for guiding comprises at least one sheave connected to said means for inserting the lower ends of the tendons.

12. The system according to claim 11 further comprising a first handling line extending from a first pulley at the surface of the water, through said sheave and to a collar which is movable along a longitudinal direction of one of said tendons, and a second handling line extending from said collar to a second pulley at the surface of the water.

13. The system according to claim 10, further comprising a remote controlled vehicle for driving said means for inserting along said circular track.

14. The system according to claim 10, wherein said tendon connection means comprises ballastable float elements flexibly connected to the upper ends of the tendons.

* * * * *